US008429926B2

(12) United States Patent
Shaha et al.

(10) Patent No.: US 8,429,926 B2
(45) Date of Patent: Apr. 30, 2013

(54) ICE STORAGE BIN AND ICEMAKER APPARATUS FOR REFRIGERATOR

(75) Inventors: Bipin Shaha, Mumbai (IN); Wayne E. Lawson, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 750 days.

(21) Appl. No.: 12/357,490

(22) Filed: Jan. 22, 2009

(65) Prior Publication Data

US 2010/0180608 A1 Jul. 22, 2010

(51) Int. Cl.
*F25D 3/02* (2006.01)
*F25D 17/06* (2006.01)
*F25C 5/18* (2006.01)

(52) U.S. Cl.
USPC ..... 62/420; 62/344; 62/424; 62/425; 62/427

(58) Field of Classification Search ..... 62/344, 62/420, 424, 425, 377, 406, 407
See application file for complete search history.

(56) References Cited

U.S. PATENT DOCUMENTS

| | | | | |
|---|---|---|---|---|
| 6,016,664 | A * | 1/2000 | Larsson et al. | 62/406 |
| 6,336,341 | B1 * | 1/2002 | McGraw et al. | 62/420 |
| 6,761,036 | B2 * | 7/2004 | Teague et al. | 62/70 |
| 7,188,479 | B2 * | 3/2007 | Anselmino et al. | 62/66 |
| 2008/0295539 | A1 * | 12/2008 | An et al. | 62/407 |

* cited by examiner

*Primary Examiner* — Mohammad Ali
*Assistant Examiner* — Keith Raymond
(74) *Attorney, Agent, or Firm* — Global Patent Operation; Douglas D. Zhang

(57) ABSTRACT

An ice storage bin and an icemaker apparatus are disclosed. The ice storage bin has a body for defining an ice collection cavity and a channel surrounding at least a substantial portion of the body for permitting fluid flow through the channel. The icemaker apparatus is disposed in a fresh food compartment of a refrigerator. The icemaker apparatus has an ice maker, above the ice storage bin, and an icemaking compartment for accommodating the ice maker and the ice storage bin.

11 Claims, 5 Drawing Sheets

ICE STORAGE BIN AND ICEMAKER APPARATUS FOR REFRIGERATOR

BACKGROUND OF THE INVENTION

The present invention relates generally to an ice storage bin and an icemaker apparatus for a refrigerator. More particularly, the present invention relates to an ice storage bin having structures for effectively improving the circulation of a cooling fluid around the ice storage bin and maintaining the ice storage bin at a proper temperature, and an icemaker apparatus using the same.

Generally, a refrigerator includes a freezer compartment and a fresh food compartment which are partitioned from each other to store various foods at low temperatures in an appropriate state for a long time.

It is now common practice in the art of refrigerators to provide an automatic icemaker apparatus. In a "side-by-side" type refrigerator where the freezer compartment is arranged to the side of the fresh food compartment, the icemaker apparatus is usually disposed in the freezer compartment and delivers ice through an opening in the access door of the freezer compartment. In this arrangement, ice is formed by freezing water with cold air in the freezer compartment, the air being made cold by the cooling system or circuit of the refrigerator including an evaporator.

In a "bottom freezer" type refrigerator where the freezer compartment is arranged below a top fresh food compartment, convenience necessitates that the icemaker apparatus is disposed in the access door of the top mounted fresh food compartment and delivers ice through an opening in the access door of the fresh food compartment, rather than through the access door of the freezer compartment. Since the fresh food compartment normally has a temperature higher than the freezing point of water, a cooling circuit is implemented to maintain the temperature of the icemaker apparatus below the freezing point of water. For example, the cooling circuit may be implemented to deliver cold air from the freezer compartment or a secondary cooling liquid, such as a mixture of propylene glycol and water, as the cooling medium to cool the icemaker apparatus so that water can be converted into ice.

If a secondary cooling liquid is used to cool the icemaker apparatus, it flows or passes through a heat exchanger of the icemaker apparatus through a conduit network or loop. Since there lacks airflow around the ice storage bin in the icemaker apparatus, the temperature of the ice storage bin tends to rise above the freezing point of water. Accordingly, the ice stored in the ice storage bin may be melted and the resulting water may cause undesirable water spill through the opening on the access door.

Therefore, it would be desirable and advantageous to provide an effective configuration and scheme for implementing air circulation within the icemaker apparatus, especially around the ice storage bin, to maintain a proper temperature of the ice storage bin.

BRIEF DESCRIPTION OF THE INVENTION

As described herein, the various exemplary embodiments of the present invention overcome one or more of the above or other disadvantages known in the art.

One aspect of the present invention relates to an ice storage bin used in an icemaker apparatus for a refrigerator. The ice storage bin includes a body defining an ice collection cavity therein and at least one channel surrounding at least a substantial portion of the body for permitting fluid flow therethrough.

Another aspect of the present invention relates to an icemaker apparatus disposed in a fresh food compartment of a refrigerator. The icemaker apparatus includes an icemaking compartment; an ice maker disposed in the icemaking compartment, the ice maker using a liquid refrigerant to convert water into ice; and an ice storage bin disposed in the icemaking compartment, the ice storage bin comprising a body defining an ice collection cavity for storing the ice produced by the ice maker and at least one channel surrounding at least a substantial portion of the body for permitting fluid flow therethrough.

Yet another aspect of the present invention relates to a method for maintaining the temperature of an ice storage bin in an icemaker apparatus disposed in a fresh food compartment of a refrigerator. The method includes providing at least one channel surrounding at least a substantial portion of the body for permitting fluid flow therethrough and circulating fluid flow through the at least one channel.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

It is contemplated that the teaching of the description set forth below is applicable to all types of refrigeration appliances, including but not limited to household refrigerators. The present invention is therefore not intended to be limited to any particular refrigeration device or configuration described in the exemplary embodiments of the present invention.

Figure 1:
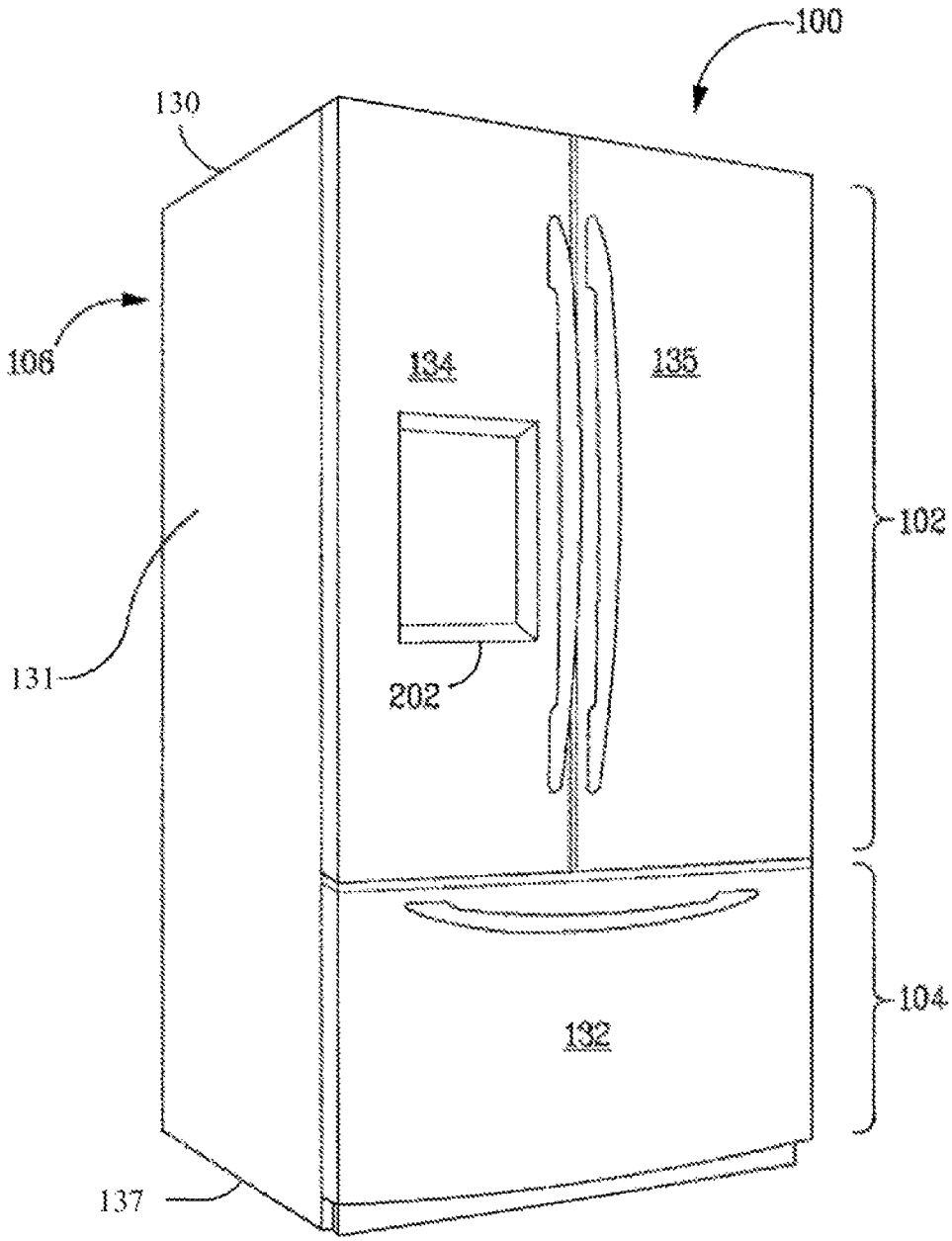
FIG. 1 is a perspective view of an exemplary refrigerator incorporating an ice storage bin and an icemaker apparatus according to an exemplary embodiment of the present invention.
Figure 2:
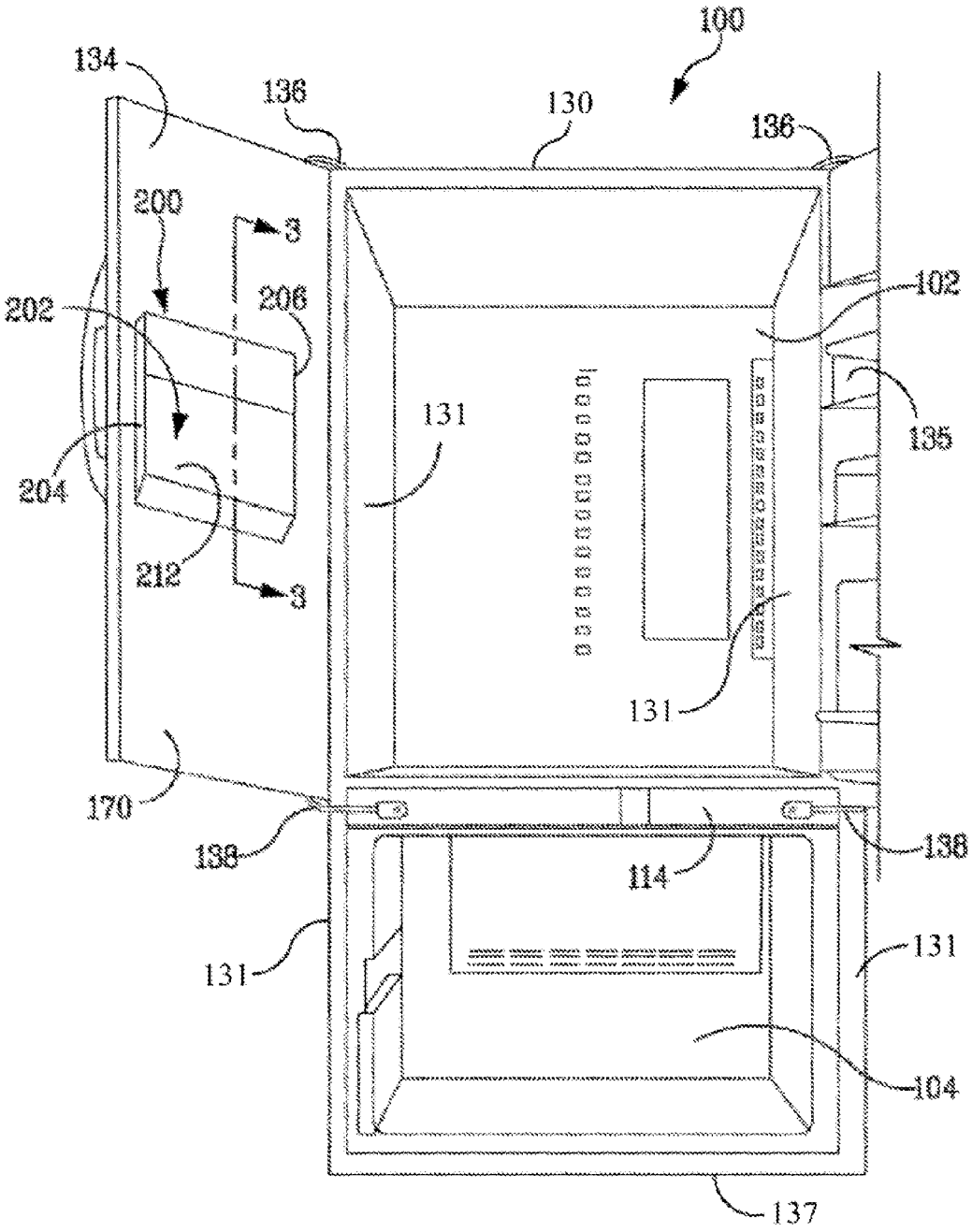
FIG. 2 is a perspective view of the refrigerator of FIG. 1 with the refrigerator doors open.

FIGS. 1 and 2 illustrate an exemplary refrigerator 100 in which an embodiment of the present invention can be practiced. In the embodiment described and illustrated herein, the refrigerator 100 is a bottom freezer type refrigerator. It is recognized, however, the benefits of the present invention are equally applicable to any other type of refrigerator, freezer, and refrigeration appliance. Consequently, the description set forth herein is for illustrative purposes only and is not intended to limit the invention in any aspect.

The refrigerator 100 includes a fresh food compartment 102 and a freezer compartment 104. The freezer compartment 104 and the fresh food compartment 102 are arranged in a bottom mount configuration where the freezer compartment 104 is disposed or arranged beneath or below the fresh food compartment 102. The fresh food compartment 102 is shown with French doors 134 and 135. However, it should be understood that a single access door can be used instead of the French doors. The freezer compartment 104 is closed by an access element 132 which can be a drawer or an access door.

The fresh food compartment 102 and the freezer compartment 104 are contained within a main body including an outer case 106. The outer case 106 can be formed by folding a sheet of a suitable material, such as pre-painted steel, into a generally inverted U-shape to form a top 130 and two sidewalls 131 of the outer case 106. A mullion 114, best shown in FIG. 2, which is for example formed of an extruded ABS material, connects the two sidewalls 131 to each other and separates the fresh food compartment 102 from the freezer compartment 104. The outer case 106 also has a bottom 137, which connects the two sidewalls 131 to each other at the bottom edges thereof, and a back (not shown).

The access element 132 and the French doors 134, 135 close access openings to the freezer compartment 104 and the fresh food compartment 102, respectively.

Each French door 134, 135 is mounted to the fresh food compartment 102 by a top hinge 136 and a corresponding bottom hinge 138, thereby rotating about the outer vertical edge of the fresh food compartment 102 between an open position for accessing the respective part of the fresh food compartment, as shown in FIG. 2, and a closed position for closing the respective part of the fresh food compartment 102, as shown in FIG. 1.

Similarly, when an access element 132 is a door, it is rotatably attached to the outer case 106 in a known fashion. When access element 132 is a drawer, it is slidably received in the cavity defined by the sidewalls 131 the mullion 114 and the bottom 137 in a known fashion.

As illustrated in FIG. 2, an icemaker apparatus 200 for freezing water and/or automatically discharging ice is mounted on the interior surface of the French door 134 of the fresh food compartment 102. The icemaker apparatus 200 is insulated to prevent the cold air of the icemaker apparatus 200 from passing into the fresh food compartment 102. The icemaker apparatus 200 delivers ice through an opening 202 (shown in FIG. 1) formed on the exterior surface of the French door 134. The opening 202 faces away from the fresh food compartment 102 when the access door 134 is closed and is formed at a height facilitating convenient access to the ice. It is contemplated that the icemaker apparatus 200 can be mounted on the French door 135 instead and/or at other suitable locations.

Figure 3:
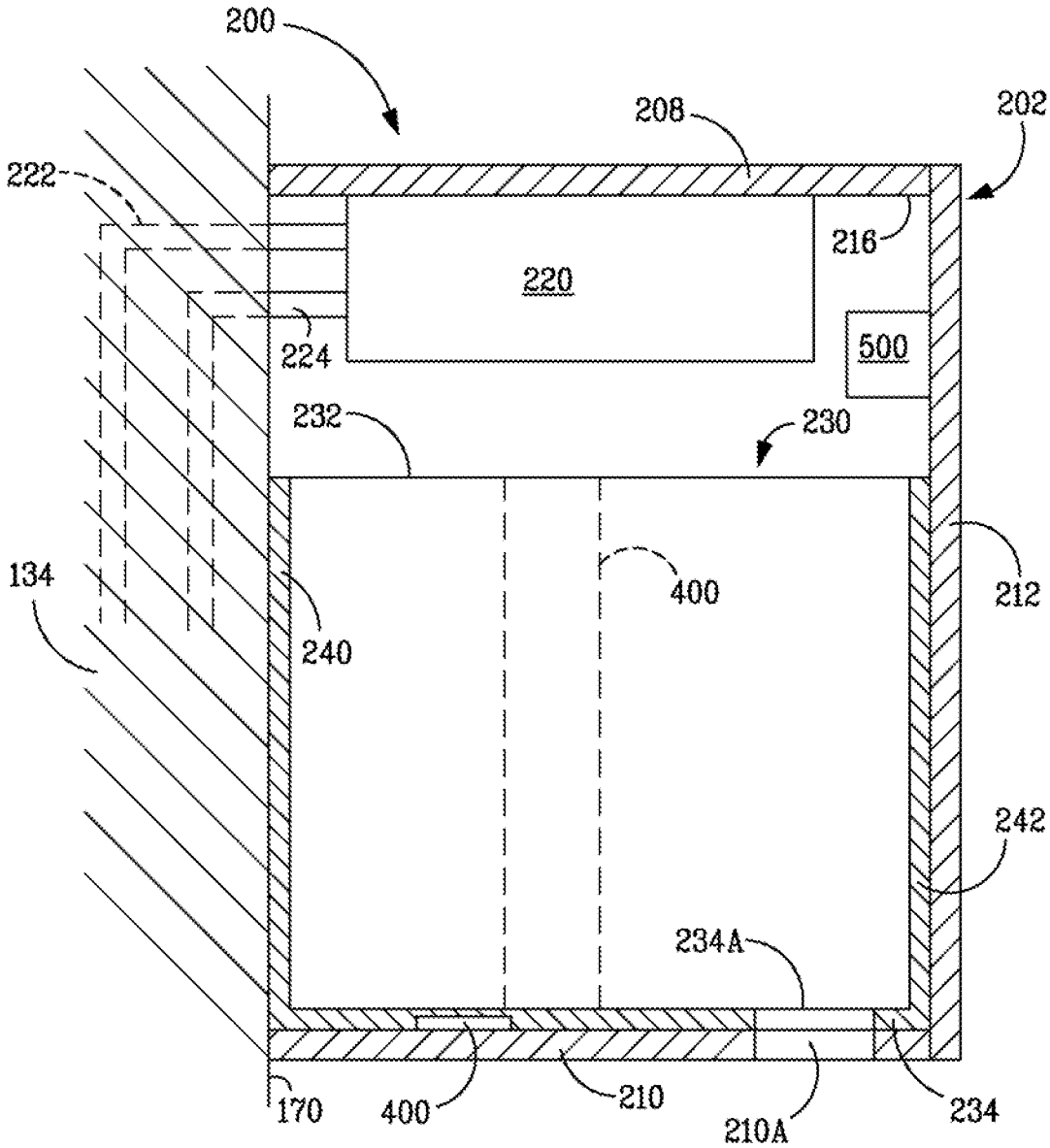
FIG. 3 is a schematic, sectional view of the ice storage bin and the icemaker apparatus along sectional arrow 3-3 of FIG. 2.

A detailed description of the configuration of the icemaker apparatus 200 will be made with reference to FIG. 3. FIG. 3 is a schematic, sectional view of the icemaker apparatus 200 along sectional arrow 3-3 of FIG. 2.

The icemaker apparatus 200 includes an icemaking compartment 202 mounted to an interior surface 170 of the door 134 of the fresh food compartment 102. The icemaking compartment 202 serves as a receiver for accommodating all the other components of the icemaker apparatus 200 and also as a shield for preventing the cold air in the icemaker apparatus 200 from passing into the fresh food compartment 102. For example, the icemaking compartment 202 includes a pair of opposing side walls 204 and 206 (shown in FIG. 2), spaced from each other and extending generally vertically. The side walls 204 and 206 are attached to the inner surface 170 of the door 134, by any suitable known means or structure. The icemaking compartment 202 further includes a top wall 208 and a bottom wall 210, spaced from each other and extending generally horizontally. The side walls 204 and 206 are connected by the top wall 208 and the bottom wall 210, respectively. The bottom wall 210 has an opening 210A, the function of which will be discussed later. The icemaking compartment 202 further includes a cover 212 for covering the space defined by the walls. The cover 212 or part of it is pivotably connected to one of the side walls 204 and 206, the top wall 208 and the bottom wall 210 to provide an access to the interior of the icemaking compartment 202. Thus, the icemaking compartment 202 provides a substantially thermally insulated structure for accommodating the components of the icemaker apparatus 200 and preventing the cold air in the icemaker apparatus 200 from passing into the fresh food compartment 102.

However, it should be readily understood that the profile or configuration of the icemaking compartment 202 is not limited to the above-described; instead the icemaking compartment 202 may assume any suitable profile or configuration, such as a half cylinder, depending on the application circumstances of the icemaker apparatus 200.

The icemaker apparatus 200 further includes an ice maker 220 received in the icemaking compartment 202, for implementing the conversion of water supplied into the ice maker 220 to ice by means of a cooling circuit (not shown) circulating a cooling medium, such as cold air or liquid refrigerant. The ice maker 220 may include a number of electromechanical elements (not shown) that manipulate one or more ice molds (not shown) to shape ice as it freezes and a mechanism (not shown) to remove or release ice from the molds. As shown in FIG. 3, the ice maker 220 is mounted to the lower surface 216 of the top wall 208, through any conventional coupling means including but not limited to screws, glue, clamps, a combination of slidable flange and slot, and so on. However, it should be understood that the ice maker 220 can be disposed in any suitable location and orientation within the icemaking compartment 202.

In the exemplary embodiment illustrated in FIG. 3, a cooling medium supply conduit 222 and a cooling medium return conduit 224 are formed in the door 134. Both the cooling medium supply conduit 222 and a cooling medium return conduit 224 are in fluid communication with the ice maker 220, for implementing thermal exchange between the cooling medium and the air and/or the components such as the ice molds in the ice maker 220, thereby lowering the temperature of the ice maker 220 below the freezing point of water. The cooling circuit is activated or deactivated based on the temperature in the icemaker apparatus 200.

The icemaker apparatus 200 further includes an ice storage bin 230 for receiving and storing the ice produced by the ice maker 220. For example, as shown in FIG. 3, the ice storage bin 230 is mounted at the lower portion of the icemaking compartment 202, under or beneath the ice maker 220. Thus, in operation, the ice falls into the ice storage bin 230 under the action of its own weight once it is released from the ice molds. However, other structure, such as a chute, can be disposed between the ice maker 220 and the ice storage bin 230 for conveying the ice to the ice storage bin 230.

The ice storage bin 230 can be disposed at any suitable location within the icemaking compartment 202, and the positional relationship between the ice maker 220 and ice storage bin 230 is not limited to the shown embodiment.

The ice storage bin 230 can be just placed in the icemaking compartment 202. Or it can be mounted into the icemaking compartment 202 through any conventional coupling means including but not limited to screws, glue, clamps, a combination of slidable flange and slot, and so on.

In the shown embodiment, the ice storage bin 230 is dimensioned to be closely fitted into the icemaking compartment 202 and sit on the bottom wall 210 of the icemaking compartment 202. However, it should be understood that a clearance or space can be provided between the ice storage bin 230 and the icemaking compartment 202.

Figure 4:
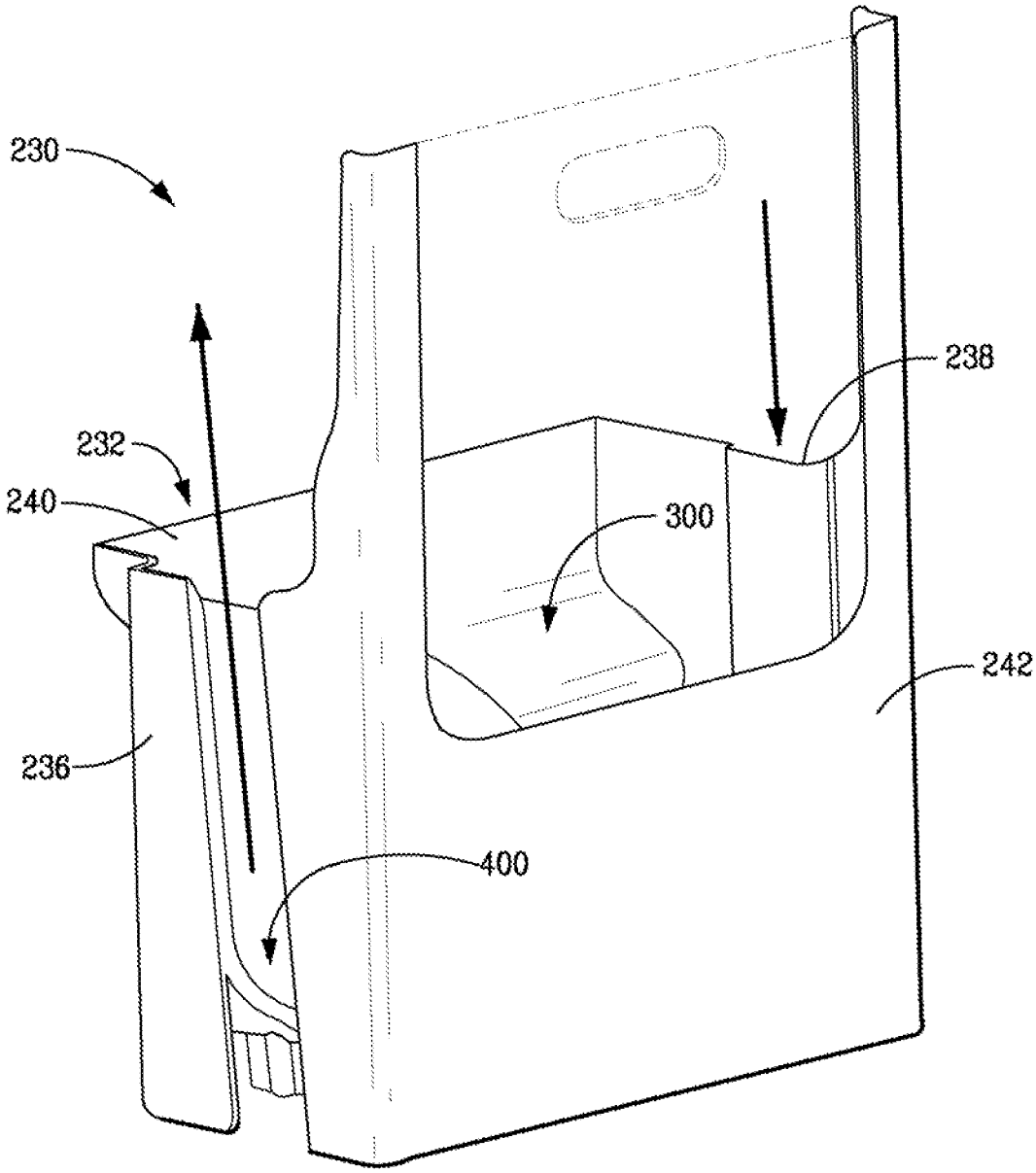
FIG. 4 is a perspective view of the ice storage bin illustrated in FIG. 3.
Figure 5:
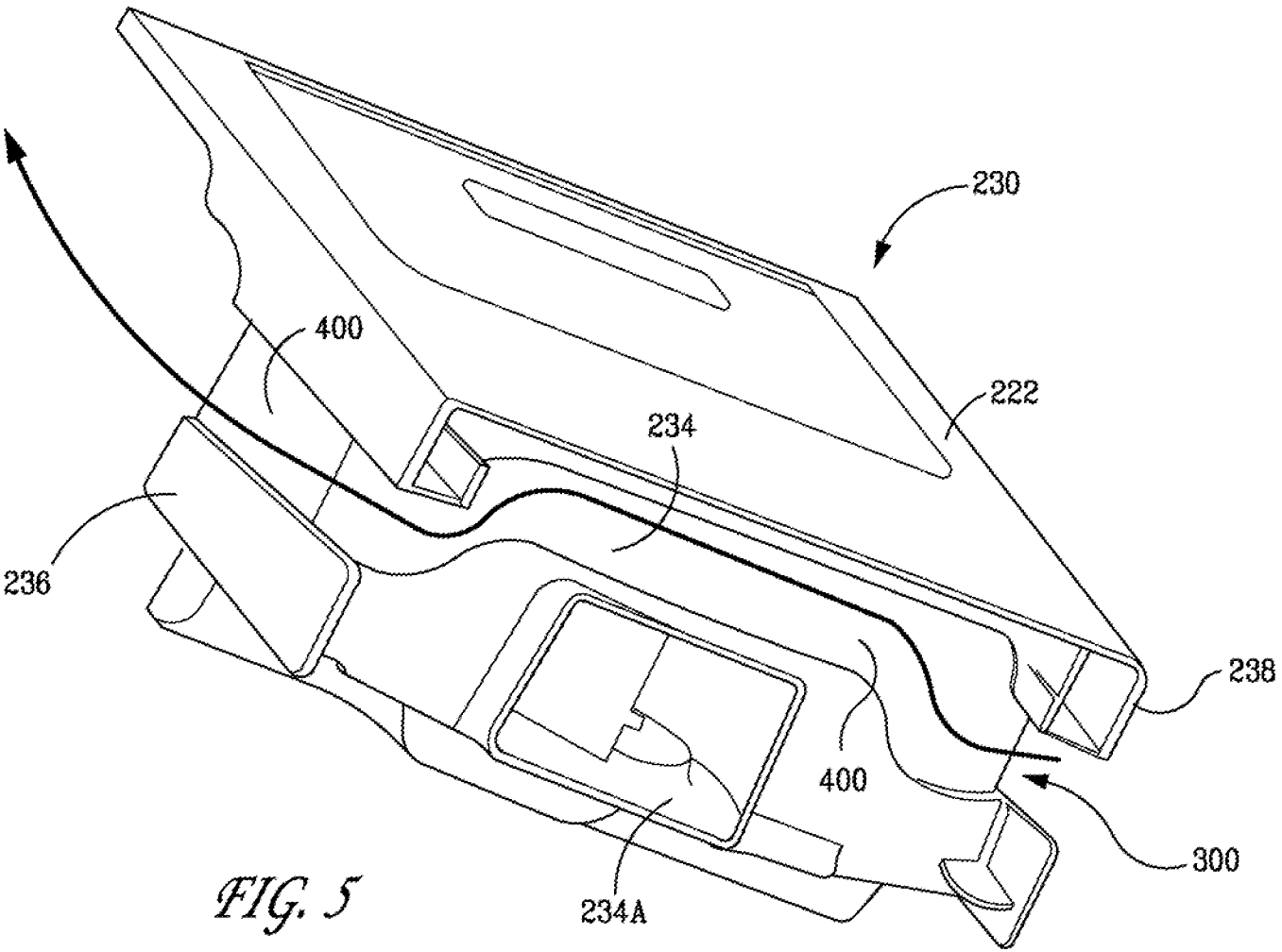
FIG. 5 is another perspective view of the ice storage bin illustrated in FIG. 3, showing the bottom of the ice storage bin.

A detailed description of the configuration and advantages of the ice storage bin 230 will be made with reference to FIGS. 4-5, wherein FIGS. 4 and 5 illustrate the ice storage bin 230 in FIGS. 2 and 3 from two different perspectives.

FIG. 4 shows the orientation of the ice storage bin 230 when it is normally installed in the icemaking compartment 202 and under or beneath the ice maker 220. FIG. 5 shows the bottom view of the ice storage bin 230.

The ice storage bin 230 includes a body 232 for defining an ice collection cavity 300 therein. The ice collection cavity 300 has a storage capacity generally sufficient for normal use of the refrigerator 100 shown in FIG. 1.

In the shown embodiment, the body 232 includes a bottom wall 234 (see FIG. 5), opposing side walls 236 and 238, opposing front wall 240 and back wall 242. The bottom wall 234 has an opening 234A generally aligned with the opening 210A so that ice can be dispatched from the ice storage bin 230 through these openings. The function of these openings are well known in the art, and therefore will not be discussed further here. The opposing side walls 236 and 238 extend from the bottom wall 234 upwardly and are connected by the opposing front wall 240 and back wall 242. Thus, the ice collection cavity 400 is defined by the bottom wall 234, the side walls 236 and 238, the front wall 240 and the back wall 242. Although the body 232 is shown having a generally rectangular shape in the exemplary embodiment, any other suitable configuration can also be applied.

The ice storage bin 230 further includes a channel 400 formed on the bottom wall and two opposite side walls of the body 232 for permitting air flow therethrough. In the exemplary embodiment, the channel 400 is formed continuously along the outer surfaces of the side walls 236 and 238 and the bottom wall 234, to provide a continuous air passageway for circulating cooling air around the ice storage bin 230 during operation. In this way, once the ice storage bin 230 is closely fitted into the icemaking compartment 202, an air passageway is provided by the open channel 400 and the matching walls of the ice storage bin 230 and the icemaking compartment 202. In other words, walls 234, 236 and 238 of ice storage bin 230 match against walls 210, 204 and 206, respectively.

In order to implement air circulation, a control unit for controlling air flow through the channel 400 is provided. Referring back to FIG. 3, the control unit includes a fan 500 disposed in the icemaking compartment 202, for example mounted to the side wall 206 of the icemaking compartment 202. The fan 500 forces the air in the icemaking compartment 202 into the channel 400 from one end thereof disposed at one of the side walls 236 and 238, and draws the air from the channel 400 from the other end thereof disposed at the other one of the side walls 236 and 238. Accordingly, the cooling or cold air flows around the ice storage bin 230 to cool the ice storage bin 230. In the shown embodiment, the channel 400 guides the air to flow (shown by the thick arrow) around the bottom portion of the ice storage bin 230.

It is understood that the fan 500 can be disposed at any suitable location depending on the location and configuration of the icemaker apparatus 200, as long as it is able to fulfill its function of controlling airflow through the channel 400. For example, if the icemaker apparatus 200 is operated by cold air drawn from the freezer compartment 104, the fan 500 can be disposed at any location along the cooling circuit for conveying the cold air. If the icemaker apparatus 200 is operated by a cooling liquid, the fan 500 is disposed within the icemaking compartment 202.

The air circulation of cold air results in decreasing the temperature of the ice storage bin 230, which effectively helps to maintain the temperature of the ice storage bin 230 below the freezing point of water. It is also understood that various configurations of the channel 400 can be contemplated without departing from the teaching of the present invention. For example, the channel can be formed in a spiral around the body of ice storage bin. Furthermore, the ice storage bin can have more than one channel for better cooling of the ice storage bin. In addition, the channel can be a closed channel formed within the sidewalls 236 and 238 and bottom wall 240 of the ice storage bin 230.

Thus, while there have been shown, described and pointed out fundamental novel features of the invention as applied to various specific embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An ice storage bin used in an icemaker apparatus for a refrigerator, comprising:

a body defining an ice collection cavity therein, the body comprising a bottom wall and opposing side walls extending from the bottom wall; and at least one continuous fluid flow channel integrated directly into the body and configured to permit a fluid to flow therethrough to cool the ice storage bin, wherein the at least one continuous fluid flow channel extends along the bottom wall and along the opposing side walls and is recessed from respective outer surfaces of the bottom wall and the opposing side walls.

2. The ice storage bin of claim 1, wherein the body further comprises opposing front and back walls extending from the bottom wall and connecting the side walls, said bottom wall, side walls, and front and back walls defining said ice collection cavity.

3. An icemaker apparatus disposed in a fresh food compartment of a refrigerator, comprising:

an icemaking compartment;

an ice maker disposed in the icemaking compartment, the ice maker using a liquid refrigerant to convert water into ice; and an ice storage bin disposed in the icemaking compartment, the ice storage bin comprising a body defining an ice collection cavity for storing the ice produced by the ice maker, the body comprising a bottom wall and opposing side walls extending from the bottom wall, and at least one continuous fluid flow channel integrated directly into the body and configured to permit a fluid to flow therethrough to cool the ice storage bin, wherein the at least one continuous fluid flow channel extends along the bottom wall and along the opposing side walls and is recessed from respective outer surfaces of the bottom wall and the opposing side walls.

4. The icemaker apparatus of claim 3, further comprising a control unit for controlling fluid flow through the at least one continuous fluid flow channel.

5. The icemaker apparatus of claim 4, wherein the control unit comprises a fan for circulating fluid flow through the at least one continuous fluid flow channel.

6. The icemaker apparatus of claim 5, wherein the fan is disposed in the icemaking compartment.

7. The icemaker apparatus of claim 3, wherein the icemaker apparatus is disposed in a door of the fresh food compartment.

8. The icemaker apparatus of claim 3, wherein the body further comprises opposing front and back walls extending from the bottom wall and connecting the side walls, said bottom wall, side walls, and front and back walls defining said ice collection cavity.

9. A method for maintaining the temperature of an ice storage bin in an icemaker apparatus disposed in a fresh food compartment of a refrigerator, comprising:

circulating a fluid through at least one continuous fluid flow channel integrated directly into the ice storage bin, wherein the at least one continuous fluid flow channel extends along a bottom wall and along opposing side walls of the ice storage bin and is recessed from respective outer surfaces of the bottom wall and the opposing side walls.

10. The ice storage bin of claim 8, wherein the at least one continuous fluid flow channel further extends along at least one of the front and back walls of the ice storage bin and is recessed from the respective outer surface of each of the front and back walls along which the at least one continuous fluid flow channel extends.

11. The ice storage bin of claim 2, wherein the at least one continuous fluid flow channel further extends along at least one of the front and back walls of the ice storage bin and is recessed from the respective outer surface of each of the front and back walls along which the at least one continuous fluid flow channel extends.

* * * * *